US008327749B2

(12) United States Patent
Underwood

(10) Patent No.: US 8,327,749 B2
(45) Date of Patent: Dec. 11, 2012

(54) FIREARM RECEIVER WITH AMBIDEXTROUS FUNCTIONALITY

(76) Inventor: Joshua A. Underwood, Salem, OR (US)

( * ) Notice: Subject to any disclaimer, the term of this patent is extended or adjusted under 35 U.S.C. 154(b) by 118 days.

(21) Appl. No.: 12/879,986

(22) Filed: Sep. 10, 2010

(65) Prior Publication Data

US 2011/0056107 A1 Mar. 10, 2011

Related U.S. Application Data

(60) Provisional application No. 61/241,350, filed on Sep. 10, 2009, provisional application No. 61/361,217, filed on Jul. 2, 2010.

(51) Int. Cl.
*F41A 19/64* (2006.01)

(52) U.S. Cl. ..... 89/138; 42/18; 42/70.02; 89/190

(58) Field of Classification Search ..... 42/18, 17, 42/70.02, 70.01; 89/138, 190, 188
See application file for complete search history.

(56) References Cited

U.S. PATENT DOCUMENTS 4,128,042 A * 12/1978 Atchisson ..... 89/138
6,557,288 B2 * 5/2003 Szabo ..... 42/70.01
8,015,742 B2 * 9/2011 Zedrosser ..... 42/70.04

* cited by examiner

*Primary Examiner* — Daniel Troy
(74) *Attorney, Agent, or Firm* — Stolowitz Ford Cowger LLP

(57) ABSTRACT

Embodiments of the present invention provide firearm receiver with ambidextrous features. Some of these features include a bolt-locking mechanism on a firearm receiver that is configured to allow an operator to clear jams while maintaining hold of a firing grip. The bolt-locking mechanism may include a linking mechanism configured to manipulate a bolt-catch device in response to activation of a magazine release button on a firearm receiver. Other features include an ambidextrous magazine release mechanism on a firearm receiver that is configured to allow an operator to release an inserted magazine while maintaining hold of a firing grip with either hand. The magazine release mechanism may include a linking mechanism configured to manipulate a magazine catch device in response to activation of either a right-handed magazine release button or a left-handed magazine release lever that pivots on an external fulcrum on a firearm receiver.

8 Claims, 22 Drawing Sheets

FIREARM RECEIVER WITH AMBIDEXTROUS FUNCTIONALITY

RELATED APPLICATIONS

This application claims priority to U.S. Provisional Patent Application 61/241,350 filed Sep. 10, 2009, entitled BOLT-LOCKING MECHANISM FOR FIREARM RECEIVER, the contents of which are hereby incorporated by reference. This application also claims priority to U.S. Provisional Patent Application 61/361,217 filed Jul. 2, 2010, entitled AMBIDEXTROUS MAGAZINE RELEASE MECHANISM, the contents of which are hereby incorporated by reference.

FIELD OF THE INVENTION

This disclosure relates generally to firearm apparatuses, and more particularly to a firearm receiver with ambidextrous features including an ambidextrous magazine release mechanism and a bolt-locking mechanism.

BACKGROUND

Firearms have existed in some form for hundreds of years. As technology progressed, firearms developed from single shot muskets to pistols and rifles capable of storing and handling multiple rounds during a firing session. While single-action revolvers, pump-actuated rifles, bolt-action rifles, and other firearms required some additional manipulation to move between spent rounds and live rounds, other semi-automatic or automatic firearms were developed that automatically discharge a spent round, load a new round in a firing chamber, and cock a firing pin without additional steps carried out by the person shooting the firearm. Often times spring loaded magazines or clips of ammunition are used by these firearms to feed another round into the firing chamber after a spent round has been ejected. When all of the rounds of the magazine have been used, the magazine can be disengaged from the firearm, and another magazine holding live ammunition can be inserted into the firearm.

While the actual method of disengaging a magazine from a firearm can vary widely between different styles of firearms, many firearm manufacturers developed a spring-loaded mechanism positioned on one side of the firearm that when activated would release a mechanical device retaining the magazine in the firearm. This mechanical retaining device advantageously holds the magazine of ammunition in the firearm so that movement of the firearm and forces placed upon the firearm during practice or combat will not unexpectedly cause the magazine to be separated from the firearm. The developed magazine release mechanism allows the mechanical retaining device to securely hold the magazine while providing a means to quickly release the retaining device so that a magazine may be removed when empty and replaced with another magazine loaded with ammunition. In some firearms, when the magazine release mechanism is activated, the magazine will drop from the firearm due to gravity when the firearm is oriented in a substantially horizontal position with the magazine facing downward.

However, the placement of magazine release mechanism on only one side of the firearm can cause complications for certain persons operating the firearm. For example, if the magazine release mechanism if located on a right side of a firearm, and the shooter is firing the firearm with his or her left hand, the magazine release mechanism may be difficult and slow to operate because it is not easily accessible by the shooter's left hand. Here, the shooter may need to remove either their left hand from the firing grip or their right hand from the barrel hand guard to activate the magazine release mechanism. While this process may work to disengage the magazine, it has a number of problems. For example, in combat situations, the configuration of the firearm requires an operator using a left handed shooting grip to either remove their trigger hand or control hand to both release the magazine and retrieve a new magazine. This greatly slows the magazine changing process and may be less safe because of the extra steps required of the hand being removed from the firearm to activate the magazine release mechanism. Here, the time required to remove a magazine may leave one defenseless long enough to be shot by an attacker. Keeping the muzzle of the weapon pointed in a safe direction can prove to be more difficult when removing either hand from the firing position to activate the magazine release. This is especially true for new operator's less familiar with the weapon.

Additionally, a frequent issue with the process of rapidly-firing firearms using spring-loaded magazines of ammunition is the occurrence of jams during the ejection and feeding cycles. Jams often occur because a round is not correctly ejected or loaded into the firing chamber, or when multiple rounds are simultaneously fed from the magazine toward the firing chamber. When a firearm jams, the jam must be cleared before the firearm will be operational again.

In many firearms, clearing a jam requires multiple steps that require both hands of an operator. For example, clearing a jam on a semi-automatic rifle for a right handed operator may require the steps of (a) removing left hand from firing position on barrel hand guard, (b) grabbing the front of the magazine well with the left hand and placing the left thumb on the bolt catch, (c) removing the right hand from the firing grip, (d) pulling the charging handle to the rear with the right hand until the bolt locks, (e) returning the right hand to the grip, (f) pushing the magazine release button with the index finger of the right hand while removing the magazine with the left hand, (g) grabbing the front of the magazine well again with the left hand, (h) running the charging handle three times with the right hand, (i) locking the bolt to the rear with the left hand on the third time, (j) visually and digitally inspect the firing chamber using the right hand to clear out any obstructions, (k) returning the right hand to the firing grip, (l) retrieving and inserting a loaded magazine with the left hand, (m) pressing the bolt release with the left hand, and (n) returning the left hand to the firing position on the barrel hand guard.

While this standard process effectively clears jams in the chamber of the firearm, it has a number of problems. For example, in combat situations, the configuration of the firearm requires an operator to remove his or her right hand (the trigger hand) from the firing grip twice to pull the bolt back and charge the firearm during this standard clearing process. Removing the right hand slows down the clearing process and may be less safe because the right hand is displaced from the firing grip. Here, the time required to clear the jam may leave one defenseless long enough to be shot by an attacker. Additionally, in newer operators, the removal of the right hand may result in less control of the firearm. That is, instead of controlling the positioning of the firearm, including maintaining a safe direction of directing the barrel of the firearm, by maintaining contact on the firing grip, the current configuration of the firearm and standard clearing process lends itself to more careless control of the firing direction of the firearm in newer users. These and other issues are addressed by embodiments of the present concept.

SUMMARY

Some embodiments of the invention provide an ambidextrous magazine release mechanism on a firearm receiver that is configured to allow an operator to release an inserted magazine while maintaining hold of a firing grip with either hand. In one embodiment, the magazine release mechanism includes a magazine catch device configured to hold an inserted magazine in a firearm receiver and a magazine release lever linked to the magazine catch device, where the magazine release lever is configured to rotate about an external fulcrum point. In another embodiment, the magazine release mechanism includes a linking mechanism configured to manipulate the magazine catch device in response to activation of either a right-handed magazine release button or a left-handed magazine release lever that pivots on an external fulcrum.

Other embodiments of the invention provide a bolt-locking mechanism on a firearm receiver that is configured to allow an operator to clear chamber jams while maintaining hold of a firing grip. In one embodiment, a bolt-locking mechanism includes a firearm receiver housing a firing chamber and a firearm bolt, a bolt-catch device installed on the firearm receiver and configured to lock the bolt in a rearward open position, a magazine release button installed in the firearm receiver and configured to release a magazine of ammunition from interfacing with the firearm receiver, and a linking mechanism installed in the firearm receiver and configured to manipulate the bolt-catch device in response to activation of the magazine release button. In other embodiments, the bolt-locking mechanism may include any type of activation device adjacent to a firing grip, where the activation device is manipulatable by an operator to lock open a firearm bolt while the operator retains contact with a firing grip of the firearm.

DETAILED DESCRIPTION

As described above, embodiments of the present invention provide a bolt-locking mechanism on a firearm receiver that is configured to allow an operator to clear chamber jams while maintaining hold of a firing grip. The bolt-locking mechanism may include any activation system that allows an operator of a firearm to maintain contact with a firing grip while locking open a firearm bolt. In some embodiments, this activation system includes a linking mechanism disposed between a magazine release button and a bolt-catch device, where the linking mechanism is configured to manipulate the bolt-catch device to lock open a firearm bolt in response to activation of the magazine release button. In other embodiments, the activation system may include a separate switch, button, or other mechanism operable by the operator of the firearm to lock open the firearm bolt while maintaining contact with a firing grip. As used herein, the term magazine refers to any type of device that is configured to hold multiple rounds of ammunition including clips, magazines, etc.

The following illustrated embodiments describe implementation of this bolt-locking mechanism on an AR-15/M16 style firearm. However, this mechanism may be used with a wide variety of other firearms that utilize a retractable firearm bolt and magazine of ammunition, such as AR-10s, HK 416s, Sig 556s, etc. Some embodiments of the bolt-locking mechanism utilize a specially manufactured receiver to accommodate the bolt-locking mechanism. Other embodiments, however, utilize modifications to implement the bolt-locking mechanism on generally available receivers. Thus, embodiments of this concept can be implemented during a manufacturing process, or can be implemented as a retrofit kit to existing receivers.

Figure 1:
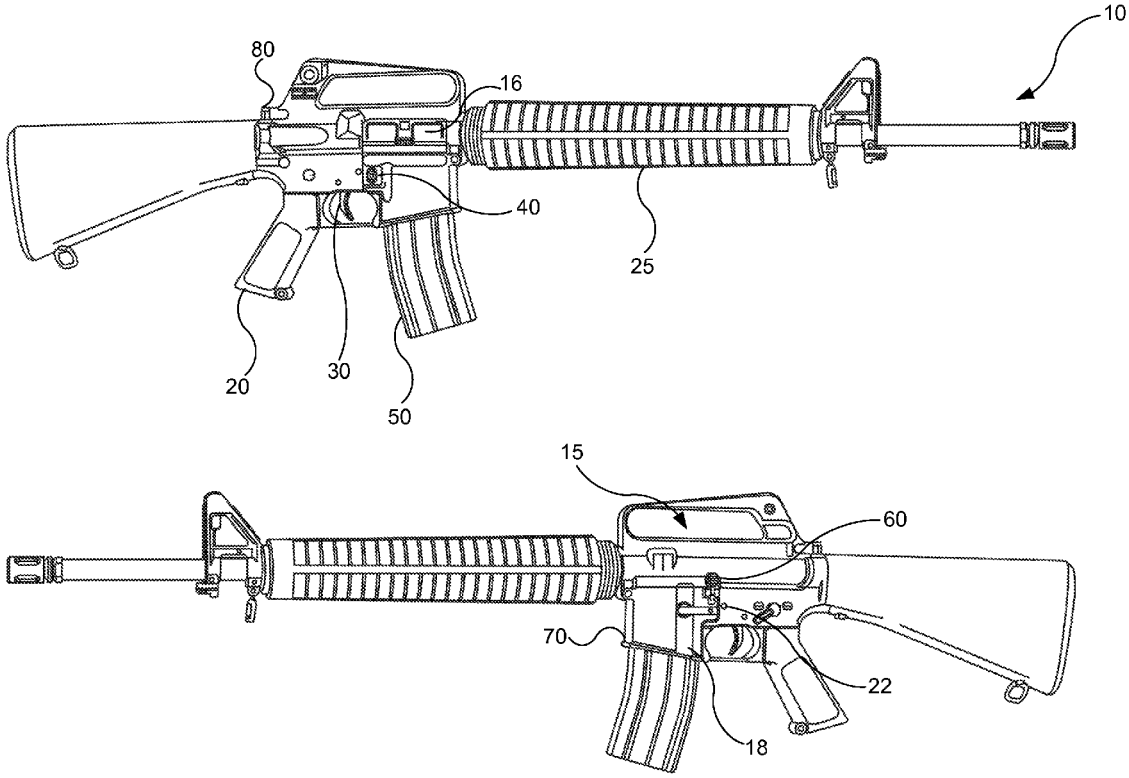
FIG. 1 is a detail view of an example firearm according to embodiments of the invention.

FIG. 1 is a detail view of an example firearm according to embodiments of the invention.

Referring to FIG. 1, each side of an AR-15/M-16 style firearm 10 is illustrated. The firearm 10 includes a receiver 15 connected to a barrel hand guard 25. The receiver 15 includes an upper portion 16 and a lower portion 18. The upper 16 and lower 18 portions of the receiver 15 may be separable structural pieces in some firearms, such as with the AR-15/M-16 style firearms, or may be a regions of a unitary structural element in other firearms. A firing grip 20 is located behind a trigger 30. The lower receiver portion 18 includes a magazine well 70 that interfaces with a magazine of ammunition 50. The magazine 50 may be removed by depressing a magazine release button 40 installed in the lower receiver portion 18 and stripping or pulling the magazine 50 out of the magazine well 70. The receiver also houses a charging handle 80, which is used to charge a bolt (not shown). A bolt-catch device 60 is used to lock a bolt in a rearward open position. The bolt-catch 60 is also activated to release the bolt into a firing position and is therefore sometimes referred to as a bolt release mechanism or button.

Figure 2A:
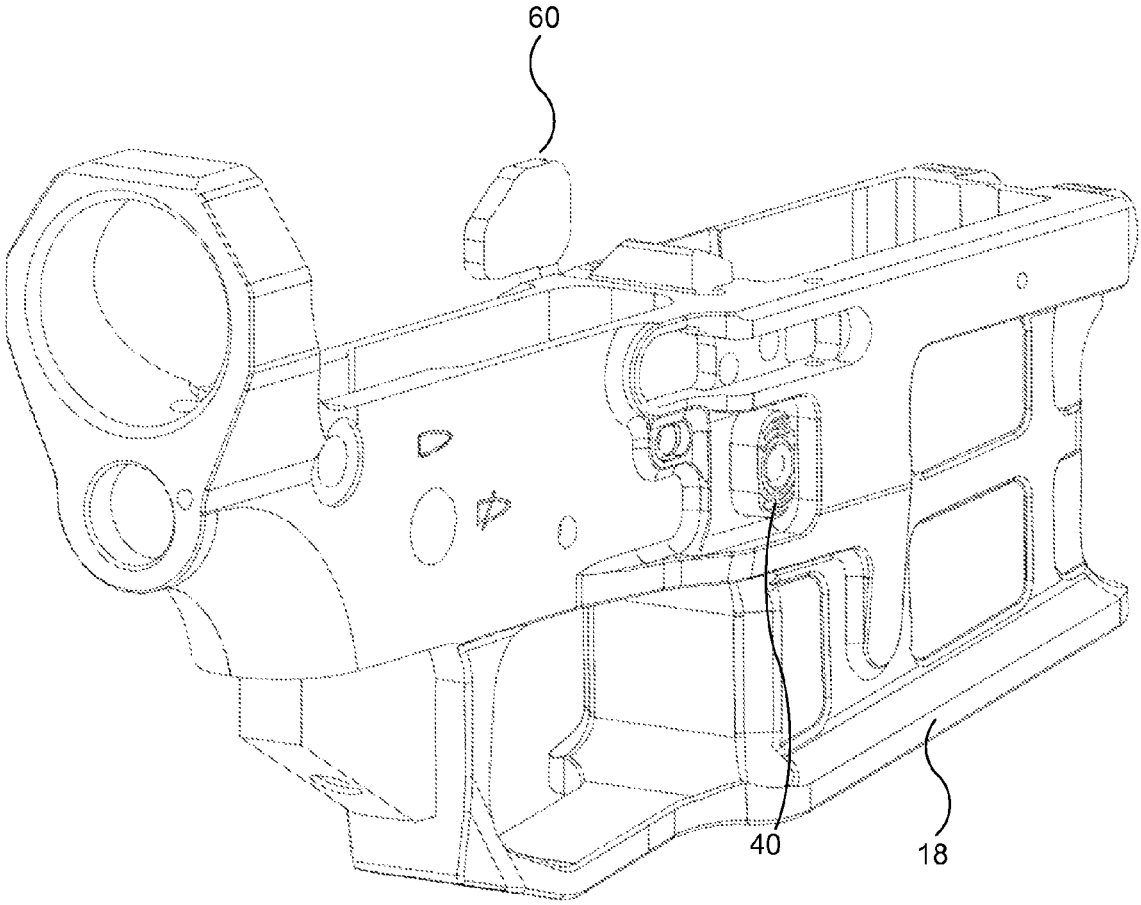
FIG. 2 is an isometric view of a bolt-locking mechanism for a firearm according to embodiments of the invention.
Figure 2B:
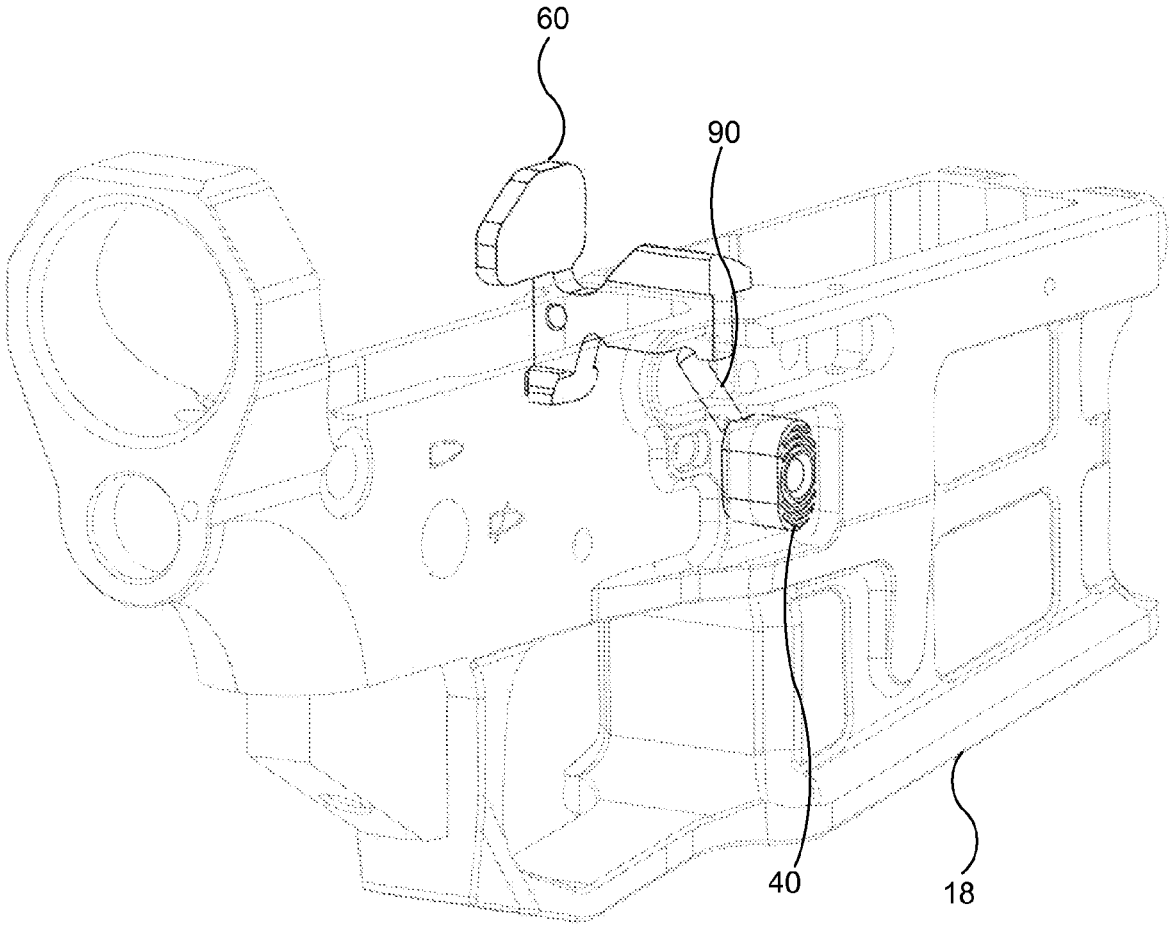

FIG. 2 is an isometric view of a bolt-locking mechanism for a firearm according to embodiments of the invention.

Referring to FIG. 2, a lower receiver portion 18 of the receiver is illustrated with the magazine release button 40 and bolt-catch 60. Also illustrated is a linking mechanism 90 that is disposed between a magazine release button 40 and a bolt-catch device 60. The linking mechanism 90 is configured to manipulate the bolt-catch device 60 to lock open a firearm bolt in response to activation of the magazine release button. As shown in this illustration, the linking mechanism 90 includes a pin 90 housed in an angularly directed hole connecting a portion of the magazine release button 40 and the bolt-catch device 60. When the magazine release button 60 is pressed inward, the pin portion of the linking mechanism 90 is forced through the hole by the movement of the magazine release button 40. As the pin 90 is forced through the hole it contacts a bottom portion of the bolt-catch device 60 rotating it upward and locking a retracted bolt. This operation is described in additional detail below with reference to FIGS. 4A-4C and FIG. 5.

In embodiments directed toward modifying existing conventional firearm receivers with a bolt-locking mechanism, several modifications of the receiver need to be completed to adapt the receiver for use with the bolt-locking mechanism. In one example, a taller and slightly longer magazine release button may be utilized where the magazine release button has an angled ramp on both ends of its inboard side to interface with the pin of the linking mechanism. Here, the taller magazine release button may allow more linear movement to be transferred to the pin as compared to a standard magazine release button. Additionally, the angled ramp may allow the pin to move with less force than if the button has a vertical wall like a conventional button. The angling of the both ends of the inboard side of the button may further allow an operator to install the button with either side up. This allows the pin to be activated while also proving about a half a turn of adjustment in determining how far the button extends pas the side of the receiver.

The bolt-catch device may have a small angled notch added to the bottom portion to facilitate a connection point for the pin of the linking mechanism. The small angled notch added to the bottom of the bolt-catch may allow the bolt-catch device to rest in a down position while allowing the pin of the linking mechanism to be long enough to fully engage the bolt-catch when the magazine release button is activated so as to be flush with or depressed from the side of the receiver.

The magazine button spring that is used to the bias the magazine release button in an outward manner may have a reduced outside diameter and length, as well as utilizing a different pitch and/or wire size. The magazine button spring may have a reduced outside diameter to create more room for a pin with an extended length necessary for fully engaging the bolt-catch device when the magazine release button is pressed and allowing the bolt-catch device to fully rest in a down position. The length, pitch, and/or wire size of the magazine button spring may be modified to allow the spring to compress far enough to have the magazine release button depress far enough for installation and/or removal of the pin of the linking mechanism.

The lower receiver portion may have a taller and/or deeper slot to accommodate the new magazine release button and allow the movement necessary to fully raise the bolt-catch device and allow installation and removal of the pin. The lower receiver portion will also have to be modified to add the angular hole for the pin of the linking mechanism.

In other embodiments, an extended leg on the lower right end of the bolt catch may be implemented to be in contact with a sloped surface of the magazine release button to raise the bolt-catch as it is depressed. In yet other embodiments, a rotating lever may be implemented that can be activated by the magazine release button to lift the bolt catch. A pin or rod can also be inserted into and fixed to the top of the magazine release button in other embodiments. This fixed pin or rod could travel along a slot and impart rotation to the bolt catch as the pin is moved across an angled surface formed on the lower portion of the bolt-catch. Many additional variations are possible and are contemplated by this invention and covered in the scope of this disclosure.

Figure 3A:
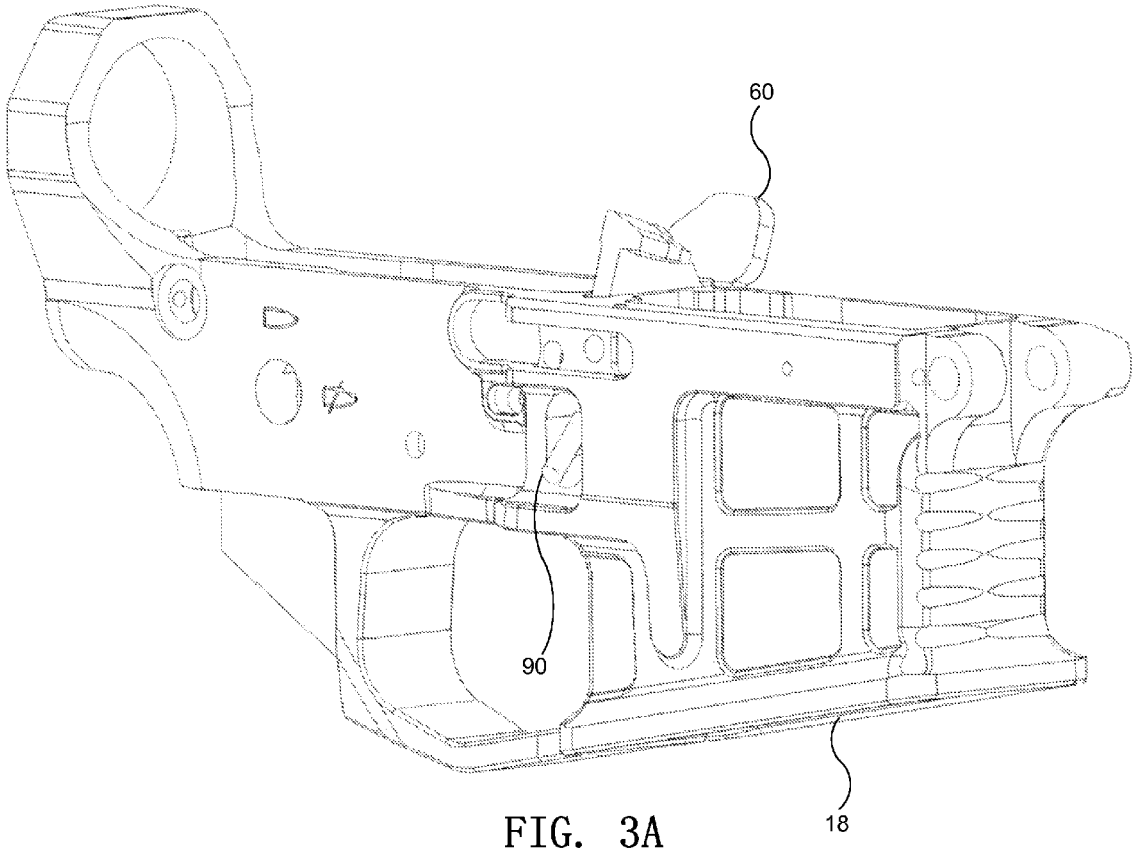
FIG. 3 is another isometric view of a bolt-locking mechanism for a firearm according to embodiments of the invention.
Figure 3B:
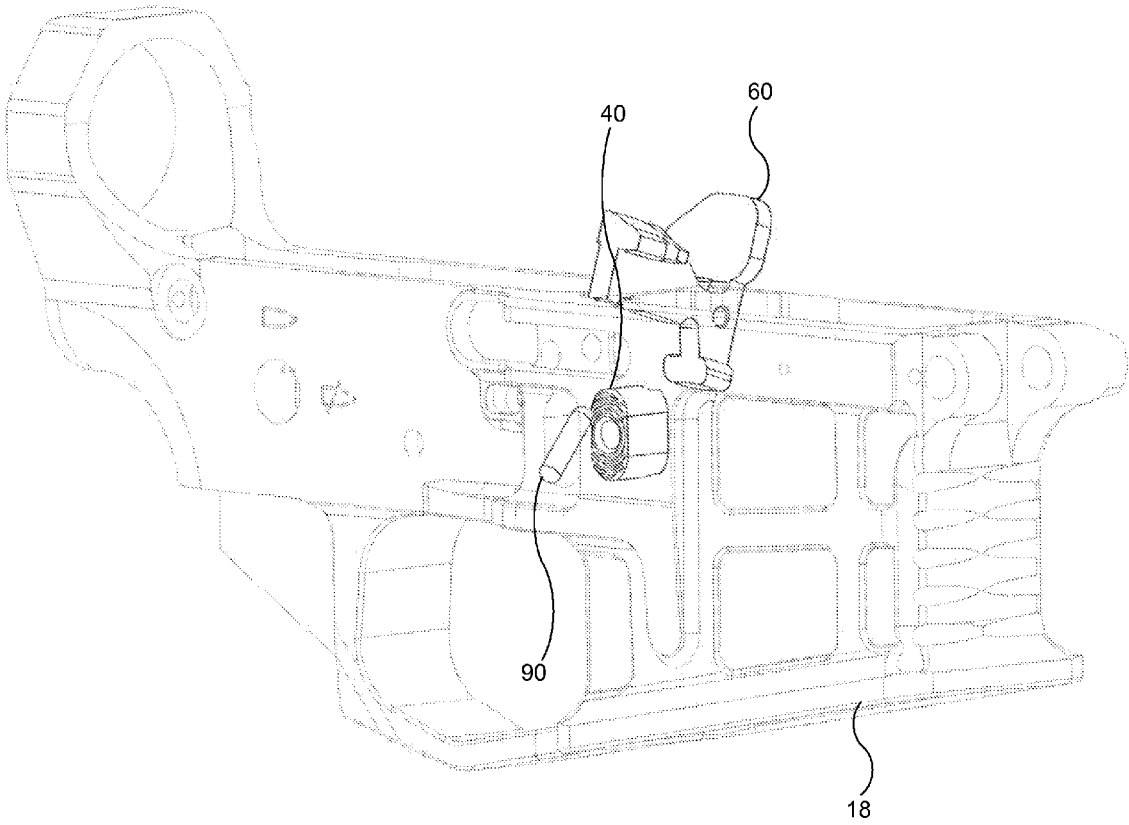

FIG. 3 is another isometric view of a bolt-locking mechanism for a firearm according to embodiments of the invention.

Referring to FIG. 3, the magazine release button 40 has been pressed-in far enough to expose the hole and pin of the linking mechanism 90. In this position, the pin 90 of the linking mechanism can be installed or removed from the hole through the opening created by the depression of the magazine release button 40. This process may be used during assembly or field stripping of the firearm, such as for cleaning, lubricating, and maintaining the firearm. In some embodiments, an object may have to be used to push the magazine button in far enough to release the pin where the magazine button hole may not be large enough to accommodate a person's finger. In other embodiments, the magazine release button may have to be removed or otherwise released before the pin 90 is able to slide out of or installed in the hole. Alternatively, in other embodiments, the magazine button spring may be biased enough that depressing the magazine release button to this depth is extremely difficult or impossible by the normal finger strength of an operator. In this case, mechanical means may be used to depress the magazine release button to a depth sufficient to install or remove the pin 90. Any of these techniques, or other known techniques, may be used to prevent the loss of the pin during activation of the magazine release button 40.

FIGS. 4A, 4B, 4C, 4D, and 4E are detail diagrams of operating a bolt-locking mechanism for a firearm according to embodiments of invention.

Figure 4A:
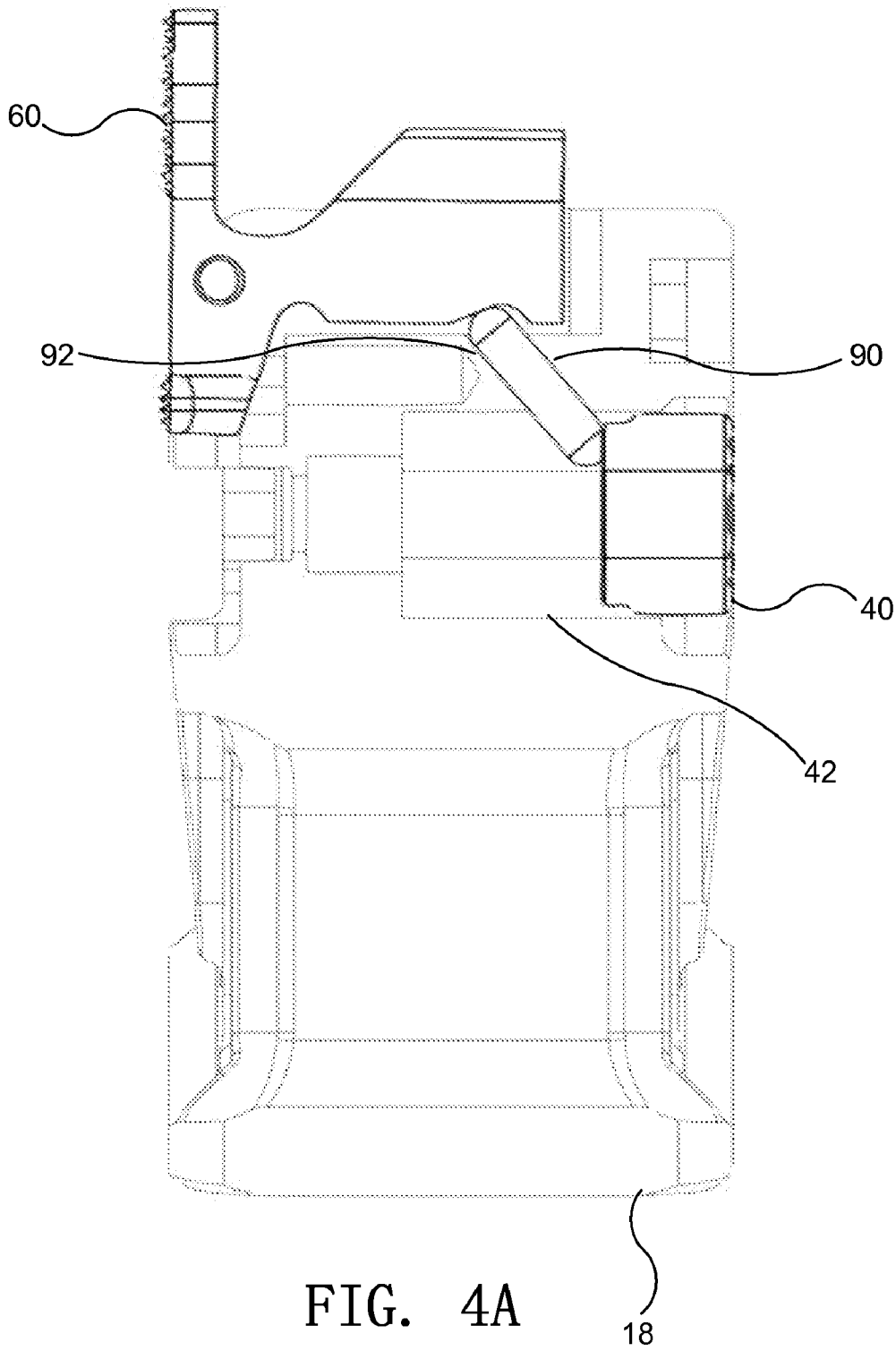
FIGS. 4A, 4B, 4C, 4D, and 4E are detail diagrams of operating a bolt-locking mechanism for a firearm according to embodiments of invention.
Figure 4B:
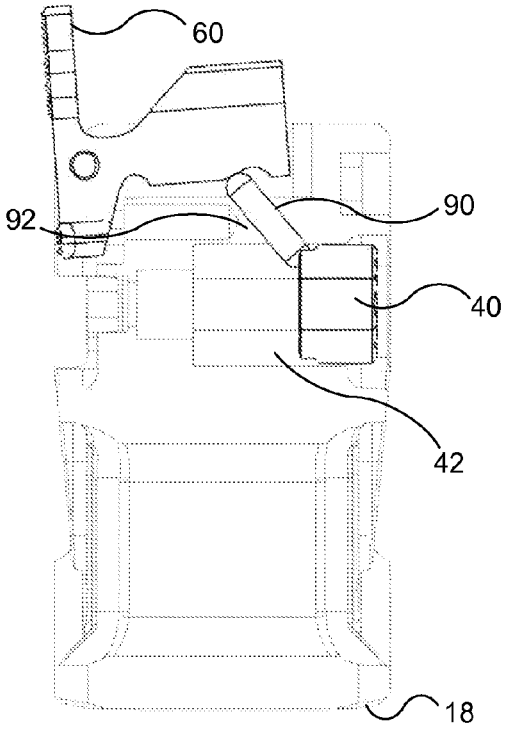
Figure 4C:
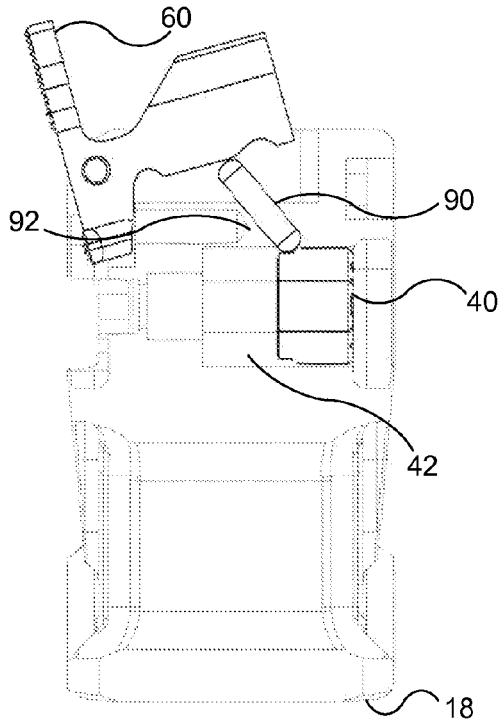
Figure 4D:
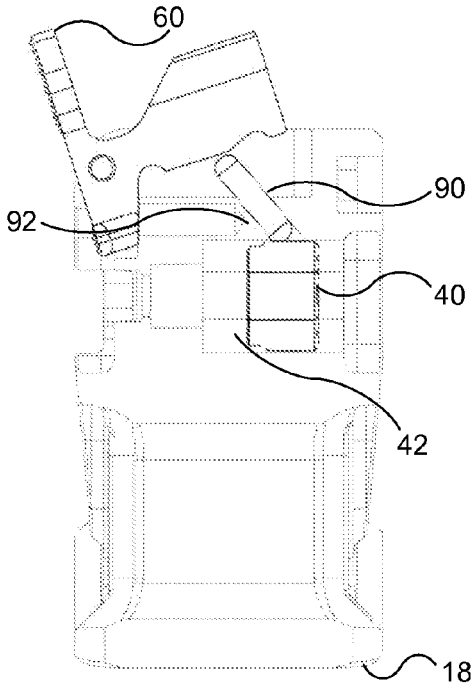
Figure 4E:
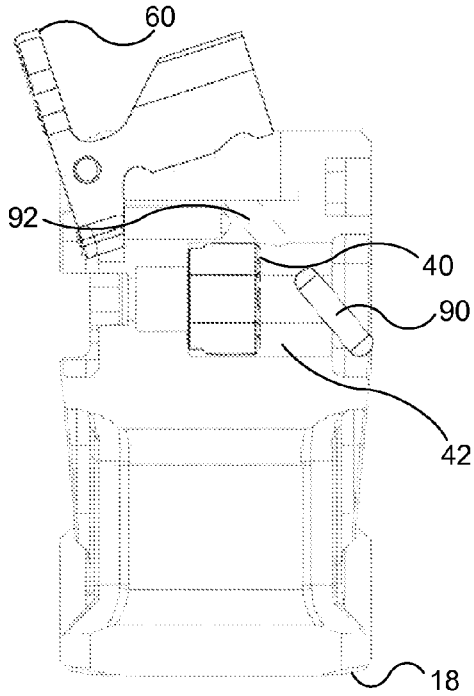

Referring to FIG. 4A, a lower portion of the firearm receiver 18 includes a magazine release button 40, a bolt-catch device 60, and a linking mechanism 90 disposed between the magazine release button 40 and the bolt-catch device 60. As FIGS. 4B-4C illustrate, as the magazine release button 40 is depressed in the magazine button cavity 42, the pin 90 of the linking mechanism is directed down an angular hole 92 and forces the rotation of the bolt-catch device 60 into a position necessary to lock the firearm bolt in a retracted open position. FIGS. 4D-4E illustrate a similar installation/removal scenario shown in FIG. 3. Here, the magazine release button 40 has been depressed far enough to expose the angular hole 92 and allow the pin 90 to be installed or removed.

Figure 5:
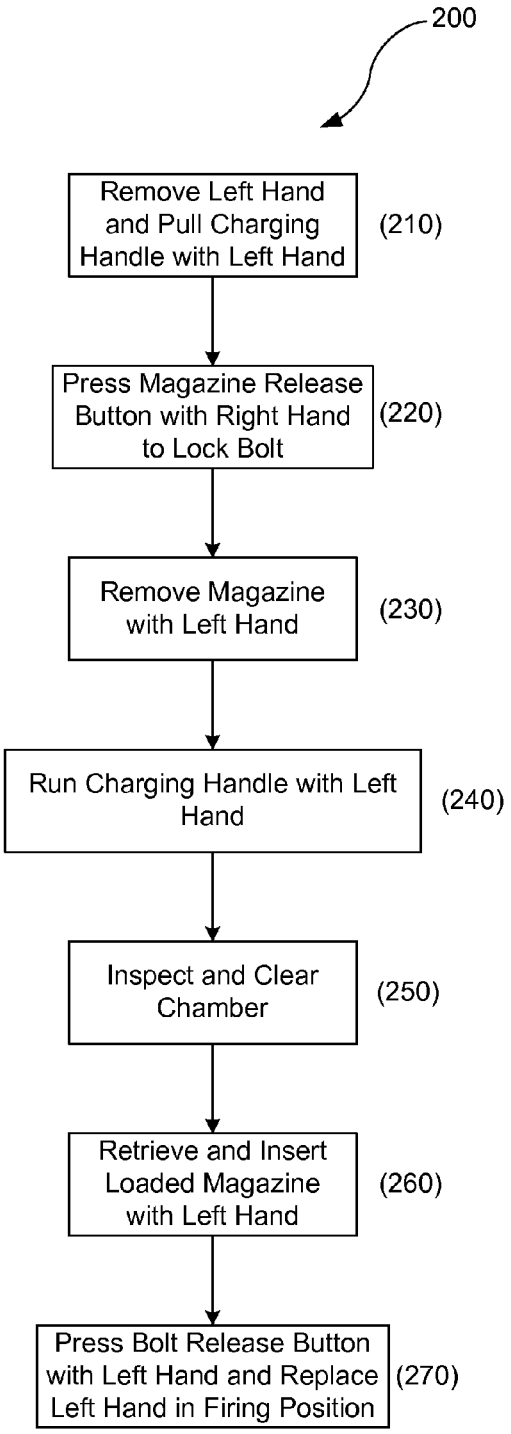
FIG. 5 is a flow diagram of an example method of clearing a firearm while maintaining a partial firing grip according to embodiments of the invention.

FIG. 5 is a flow diagram of an example method of clearing a firearm while maintaining a right hand firing grip according to embodiments of the invention.

Referring to FIG. 5, flow 200 begins in process (210) where a right-handed operator removes his or her left hand from a firing position on the barrel hand guard and pulls the charging handle. In process (220), the operator presses the magazine release button with the index finger of his right hand while maintain contact with the firing grip to lock the bolt. While the magazine release button is depressed, the operator then removes the magazine with his left hand in process (230). In process (240), the operator then runs the charging handle with his left hand while pressing the magazine release button to lock the bolt. Here, the operator may run the charging handle one, two, three times, or more as necessary. Afterwards, the operator inspects the chamber and clears any obstructions with his left hand in process (250). After confirming that the chamber is clear, the operator retrieves a loaded magazine and inserts it in the magazine well of the firearm receiver with his left hand in process (260). In process (270), the operator presses the bolt release button (bolt-catch) with his left hand to release the locked bolt and returns his left hand to its firing position on the barrel hand guard.

Note that during this entire clearing process, the operator maintains contact with the firing grip with his right hand. This keeps the firing hand close to the trigger and provides additional security of the firearm by allowing a right handed shooter better muzzle control. Additionally, this process can be completed faster than a standard clearing routine of a conventional firearm. Another advantage of this concept is that it precludes an operator from locking the bolt back with a loaded magazine in the firearm, which would prevent an unexpected chambering of a round.

Non-Rotating Hammer Pin

In another concept, a lower portion of a firearm receiver and hammer pin are configured so that the hammer pin does not rotate within a hammer pin hole formed in the lower receiver portion. In conventional firearm designs, the repeated rotation of the hammer pin in the hammer pin hole from the cycling of the firearm hammer creates wear on the walls of the hammer pin hole thereby creating potential operation inefficiencies and potential firing malfunctions in addition to shortening the life of the receiver. Embodiments of the present concept provide a hammer pin that is configured to engage the lower portion of the firearm receiver to prevent rotation during activation of the firearm hammer. In some embodiments, the hammer pin is structured to include an elongated head that resides in a slot formed in the lower receiver portion when the hammer pin is in an assembled or closed position. The slot may be formed during the manufacture of the lower receiver or may be milled into existing receivers as a part of a retrofit process that includes providing a new hammer pin structured with an elongated head corresponding to the milled slot. Other configurations of the hammer pin and lower receiver portion are possible that provide a similar function of preventing the rotation of the hammer pin during activation of the firearm hammer. For example, the lower portion of the receiver may include small protrusion that engages an extended portion of the hammer pin. Although not specifically illustrated, these variations are contemplated by this concept and are include within the scope of this disclosure.

Figure 6A:
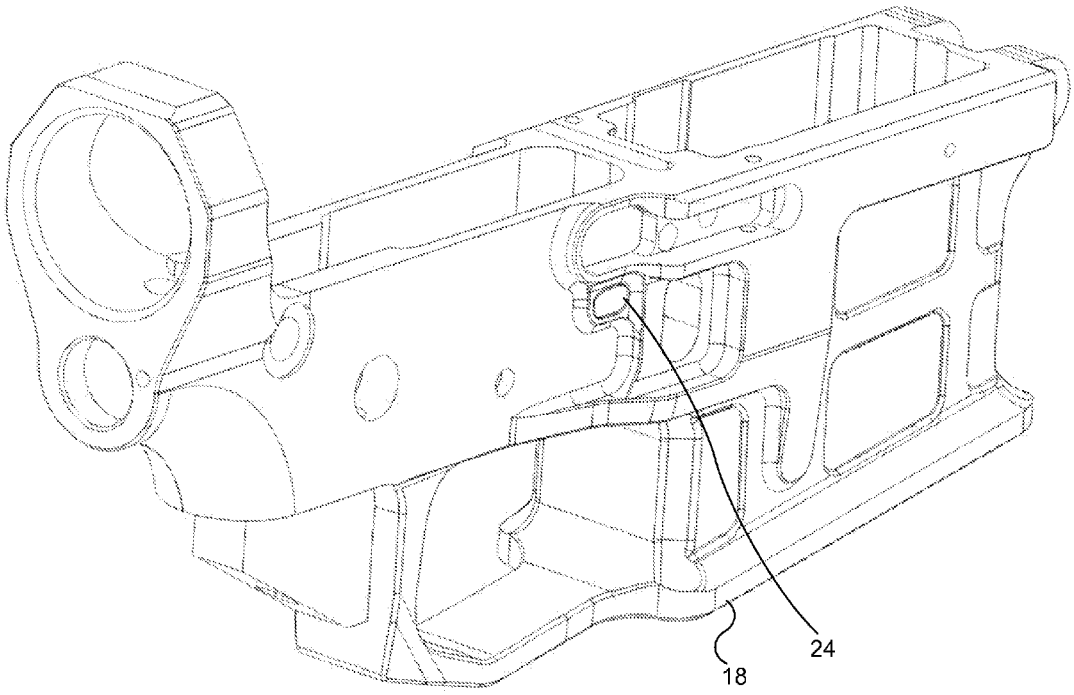
FIGS. 6A, 6B, and 6C are isometric views of a lower receiver portion having a non-rotating hammer pin according to embodiments of the invention.
Figure 6B:
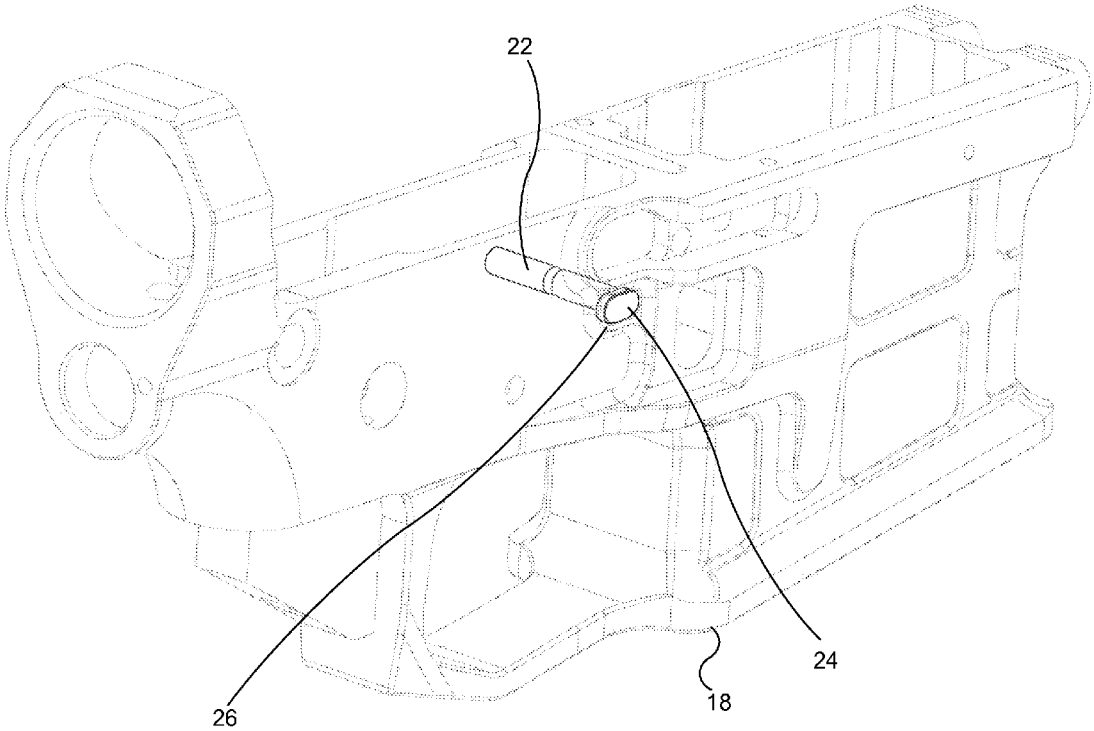
Figure 6C:
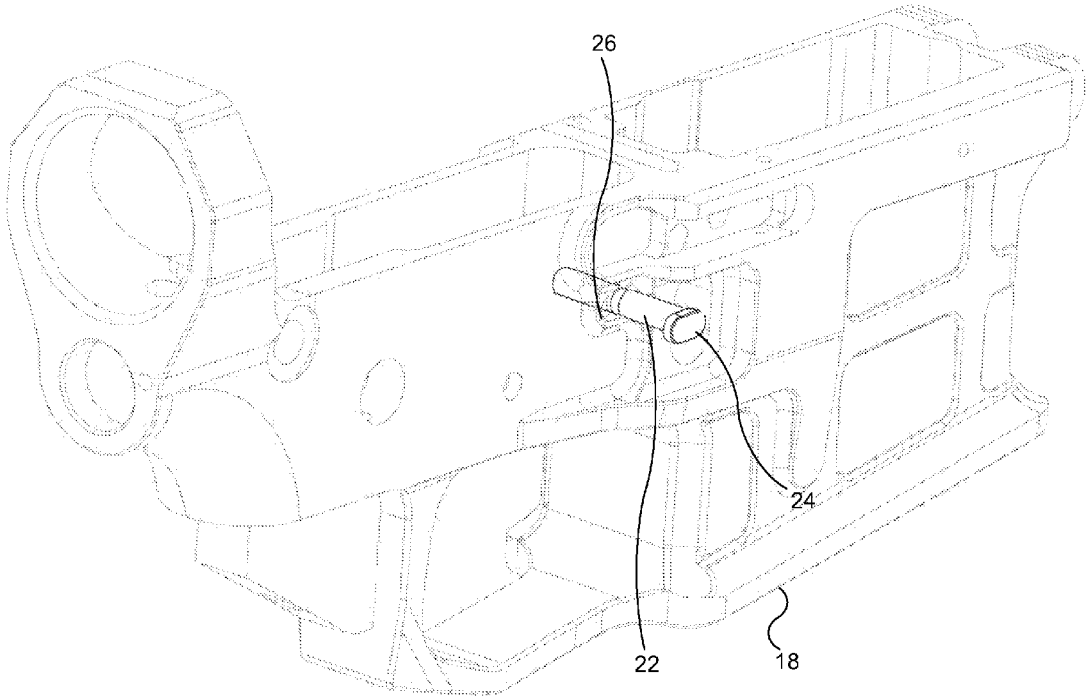

FIGS. 6A, 6B, and 6C are isometric views of a lower receiver portion having a non-rotating hammer pin according to embodiments of the invention.

Figure 6D:
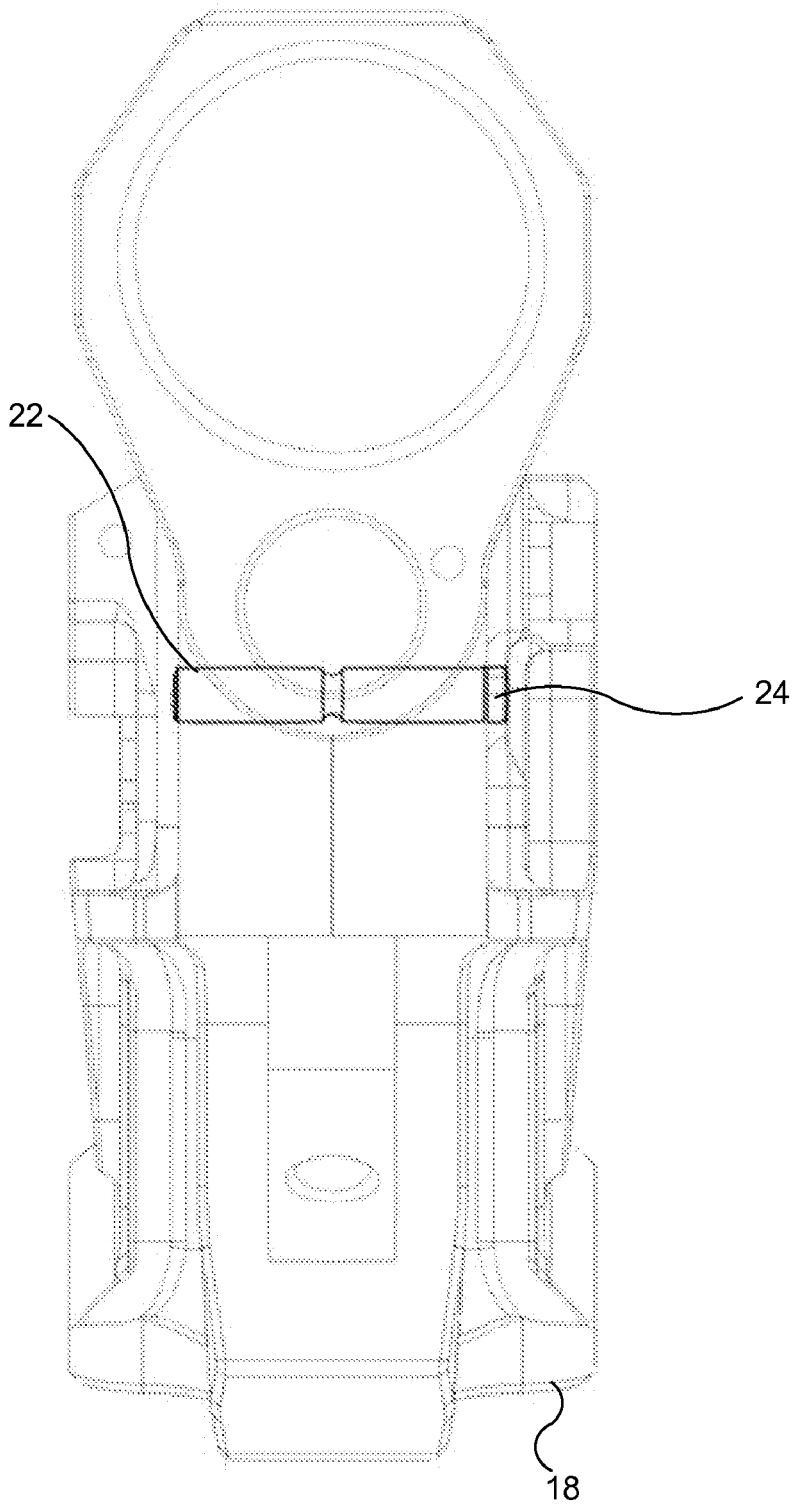
FIG. 6D is a detail diagram of a lower receiver portion having a non-rotating hammer pin according to embodiments of the invention.

FIG. 6D is a detail diagram of a lower receiver portion having a non-rotating hammer pin according to embodiments of the invention.

Referring to FIGS. 6A-6D a lower receiver portion 18 includes a slot 26 that engages a head portion 24 of a hammer pin 22. As shown in FIGS. 6A, 6B, and 6D, when the hammer pin 22 is in the assembled position, the elongated shape of the head portion 24 of the hammer pin 22 resides in the slot 26 and prevents the hammer pin 22 from rotating during the activation of a firearm hammer (not shown). FIG. 6C illustrates an assembly or disassembly step whereby the hammer pin 22 is retracted from the lower portion of the receiver 18.

Ambidextrous Magazine Release Mechanism

As described above, embodiments of the present invention provide an ambidextrous magazine release mechanism on a firearm receiver that is configured to allow an operator to release an attached magazine while maintaining hold of a firing grip with either hand. The ambidextrous magazine release mechanism may include any activation system that allows an operator of a firearm to maintain contact with a firing grip while releasing a magazine. In some embodiments, this activation system includes a linking mechanism disposed between a right-handed magazine release button and a left-handed magazine release lever, where the linking mechanism is configured to manipulate a magazine catch device to disengage from an inserted magazine. In other embodiments, the activation system may include separate mechanisms to manipulate the magazine catch device. In some illustrated embodiments below, a magazine release button is disposed on a right side of firearm receiver and a magazine release lever is disposed on a left side of the firearm receiver. However, this configuration may be reversed in other embodiments so that magazine release button is disposed on a left hand side of a firearm receiver and a magazine release lever is disposed on the right hand side of the receiver, such as in a case of specifically designed left handed firearm. Additionally, although an ambidextrous magazine release mechanism is shown at certain locations relative to a firearm receiver, these locations may be modified, as well as any connection points between portions of the ambidextrous magazine release mechanism in other embodiments of this concept.

The following illustrated embodiments describe implementation of this ambidextrous magazine release mechanism on an AR-15/M16 style firearm. However, this mechanism may be used with a wide variety of other firearms that utilize a magazine of ammunition, such as AR-10s, HK 416s, Sig 556s, etc. Some embodiments of the ambidextrous magazine release mechanism utilize a specially manufactured receiver to accommodate the ambidextrous magazine release mechanism. Other embodiments, however, utilize modifications to implement the ambidextrous magazine release mechanism on generally available receivers. Thus, embodiments of this concept can be implemented during a manufacturing process, or can be implemented as a retrofit kit to existing receivers.

Figure 7A:
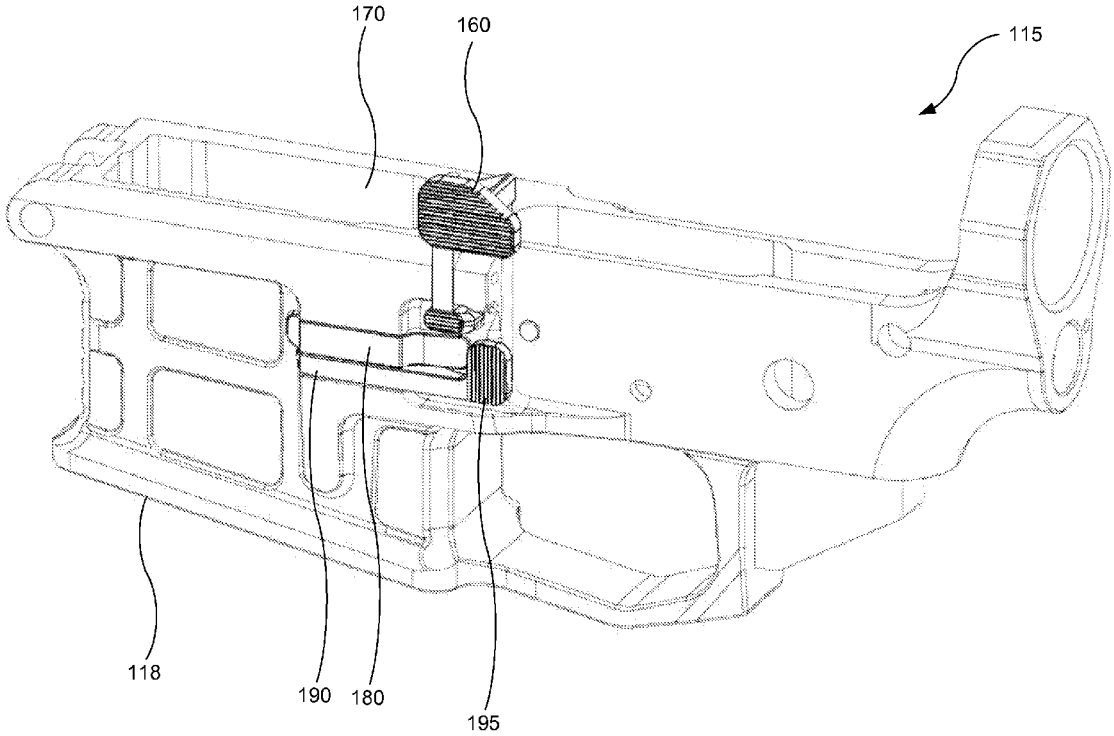
FIG. 7A is an isometric view of a left hand magazine release mechanism for a firearm according to embodiments of the invention.
Figure 7B:
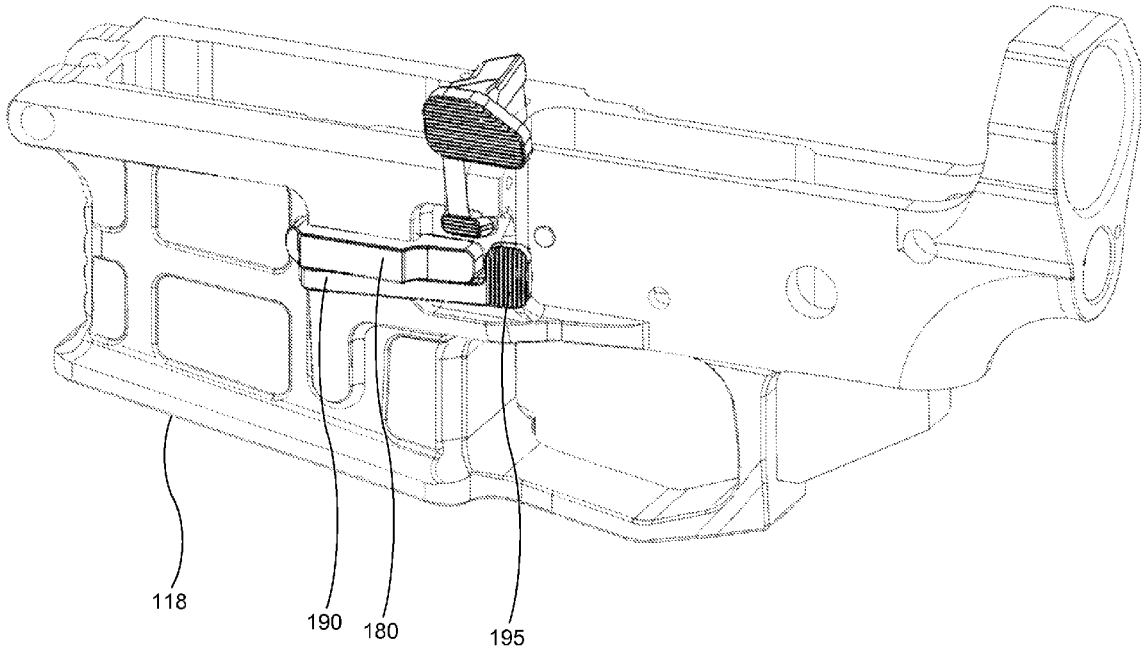
FIG. 7B is another isometric view of the left hand magazine release mechanism shown in FIG. 7A, except in an activated state.
Figure 7C:
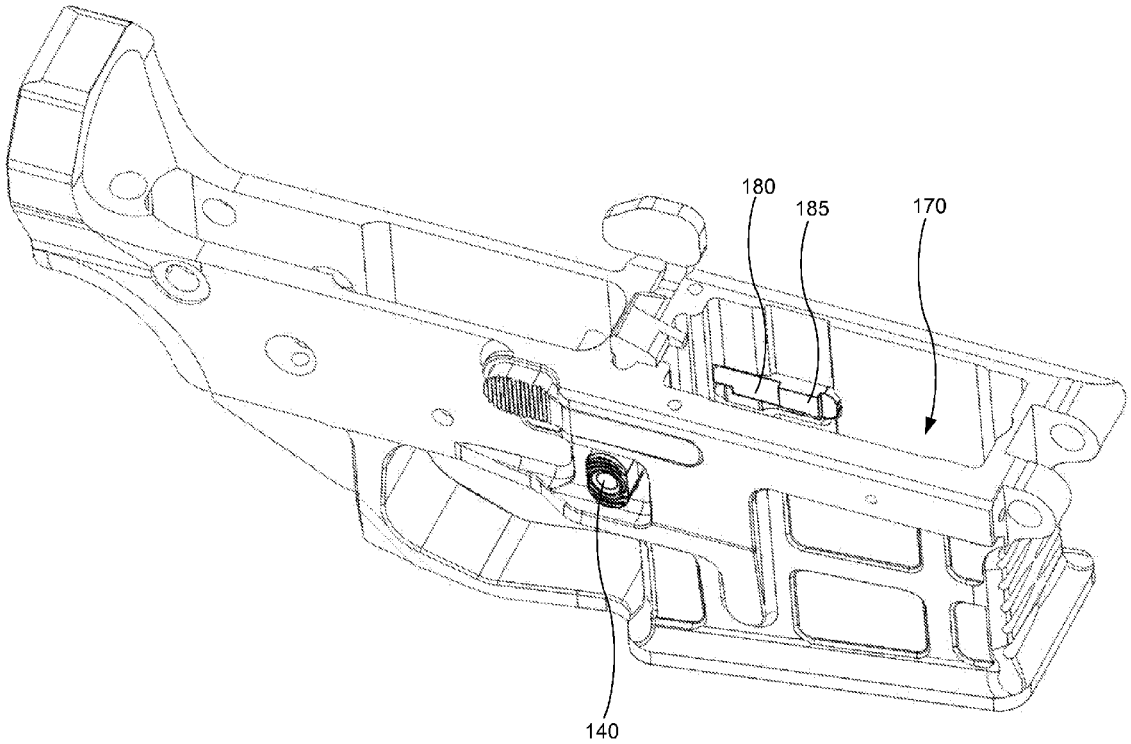
FIG. 7C is an upper perspective view of the left hand magazine release mechanism shown in FIG. 7A.

FIG. 7A is an isometric view of a left hand magazine release mechanism for a firearm according to embodiments of the invention. FIG. 7B is another isometric view of the left hand magazine release mechanism shown in FIG. 7A, except in an activated state. FIG. 7C is an upper perspective view of the left hand magazine release mechanism shown in FIG. 7A.

Referring to FIGS. 7A-7C, a firearm receiver 115 having a lower receiver portion 118 includes a magazine well 170 and has a bolt-catch 160 mounted to the lower receiver portion. A magazine catch device 180 with a raised catch portion 185 is disposed in a slot of the lower receiver portion 118 and is used to hold a magazine 50 (FIG. 1) in the magazine well 170. A magazine release button 140 in disposed on a right side (from a firing position) of the lower receiver portion 118 and is connected to the magazine catch device 180 such that when the magazine release button is depressed the magazine catch device is pushed outward in its slot to disengage the raised catch portion 185 from an indentation in a magazine to allow the magazine to be released. A magazine release lever 190 is disposed on a left side (opposite the magazine release button 140) of the lower receiver portion 118 and is connected to the magazine catch device 180 such that when a lever end portion 195 is depressed the magazine catch device 180 is also pushed outward in its slot to disengage the raised catch portion 185 from a magazine to allow the magazine to be released.

Figure 8A:
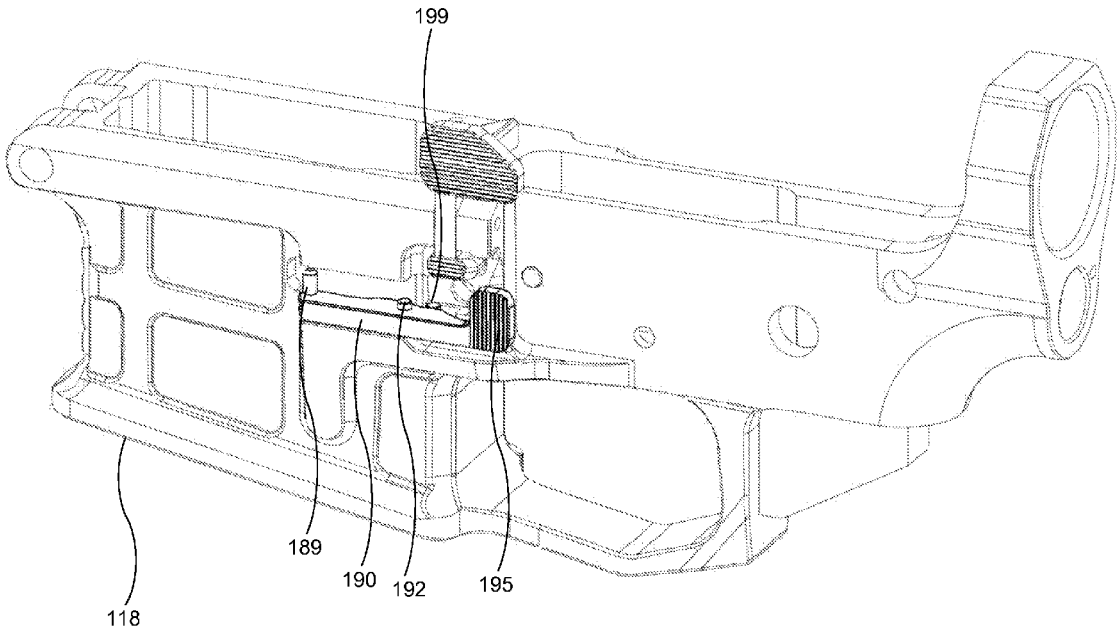
FIGS. 8A and 8B are detail diagrams of a magazine release lever in a left hand magazine release mechanism according to embodiments of invention.
Figure 8B:
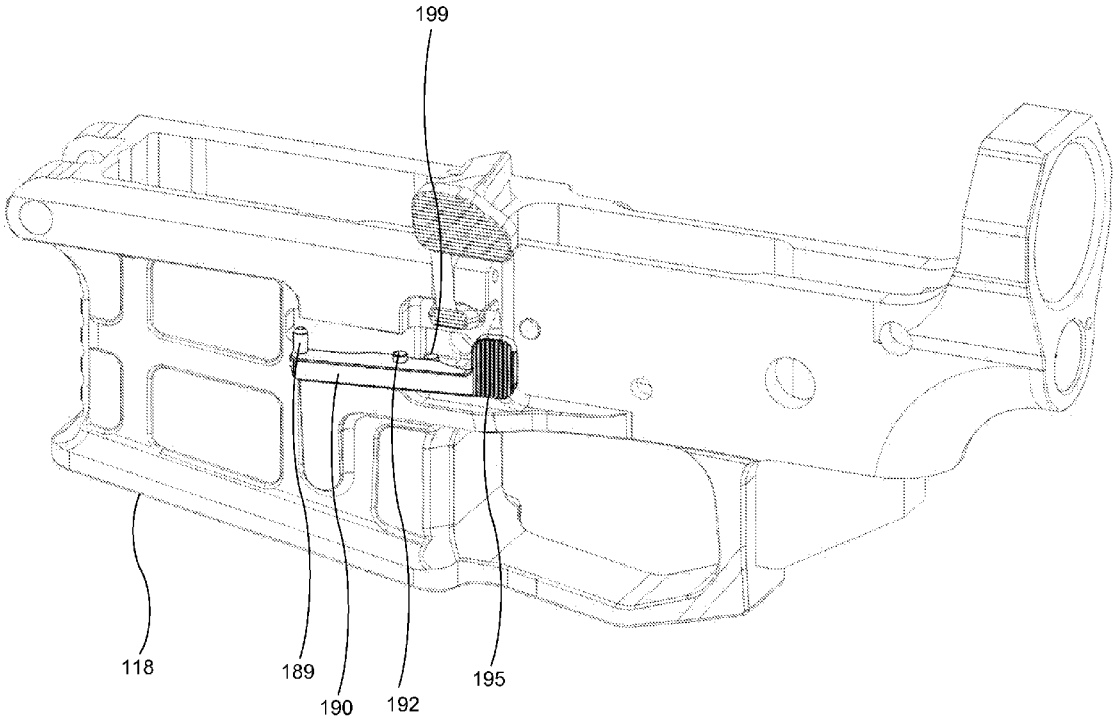

FIGS. 8A and 8B are detail diagrams of a magazine release lever in a left hand magazine release mechanism according to embodiments of invention.

Referring to FIGS. 8A and 8B, the magazine catch device 180 (FIG. 7A) is removed to show an example connection mechanism for the magazine release lever 190. FIG. 8A shows the magazine release lever 190 is a neutral state or magazine-locking position, and FIG. 8B shows the magazine release lever in an activated state where the magazine catch is disengaged allowing the magazine to be released.

The magazine release lever 190 is connected to the magazine catch device (not shown in FIG. 8A or 8B; see 180 in FIGS. 7A and 7B) with a pin link 189, which is located on an end opposite of the lever end portion 195. Although an integral pin is shown as the link 189 in this illustrated embodiment, various other connection means may be used to transmit movement to the magazine release lever 190 and magazine catch device 180. A raised stop 192 is disposed on the magazine release lever 190 to restrict outward movement of the magazine release lever. An external fulcrum 199 is disposed on lower receiver portion 118 and is adjacent to the magazine release lever 190. During activation of the magazine release lever 190 where the lever end portion 195 is depressed, the magazine release lever may rotate about the external fulcrum 199 so that the connection link 189, and hence the magazine catch device, is pushed away from the lower receiver portion 118.

Figure 9:
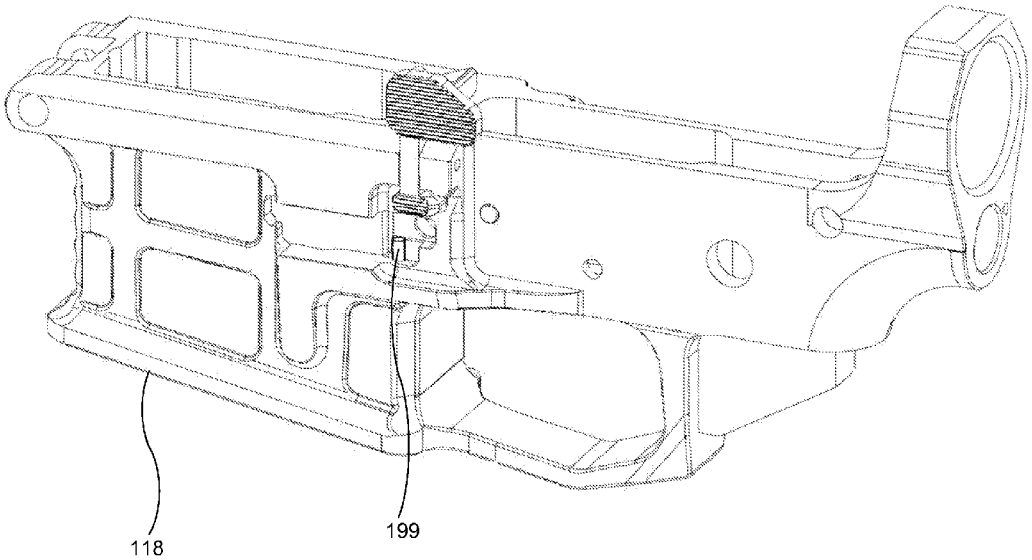
FIG. 9 is a detail diagram of an external fulcrum point for a left hand magazine release mechanism according to embodiments of invention.

FIG. 9 is a detail diagram of an external fulcrum point for a left hand magazine release mechanism according to embodiments of invention.

Referring to FIG. 9, the magazine catch device 180 and magazine release lever 190 are removed to show additional details of the external fulcrum 199. In the illustrated embodiment, the external fulcrum 199 is a pin disposed on the lower receiver portion 118 behind the magazine release lever 190. However, in other embodiments, the external fulcrum 199 may include a raised portion of material integrated with the lower receiver portion 118, a raised portion of material integrated with the magazine release lever 190, or another mechanism that allows the magazine release lever to be rotated relative to the lower receiver portion. The axis of rotation for the magazine release lever 190 relative to the external fulcrum 199 may be parallel but not coaxial to a rotational axis defined by a rotation point located within the magazine release mechanism. That is, instead of rotating on an internal hinge, pin, or other rotation point, the magazine release lever may be structured to rotate on a fulcrum point 199 that is external to the magazine release lever 190. One advantage of this structure is that it allows for much less complicated disassembly of the magazine release lever and magazine catch device. One example of a simplified disassembly process for an ambidextrous magazine release mechanism is detailed below with reference to FIG. 10.

Figure 10:
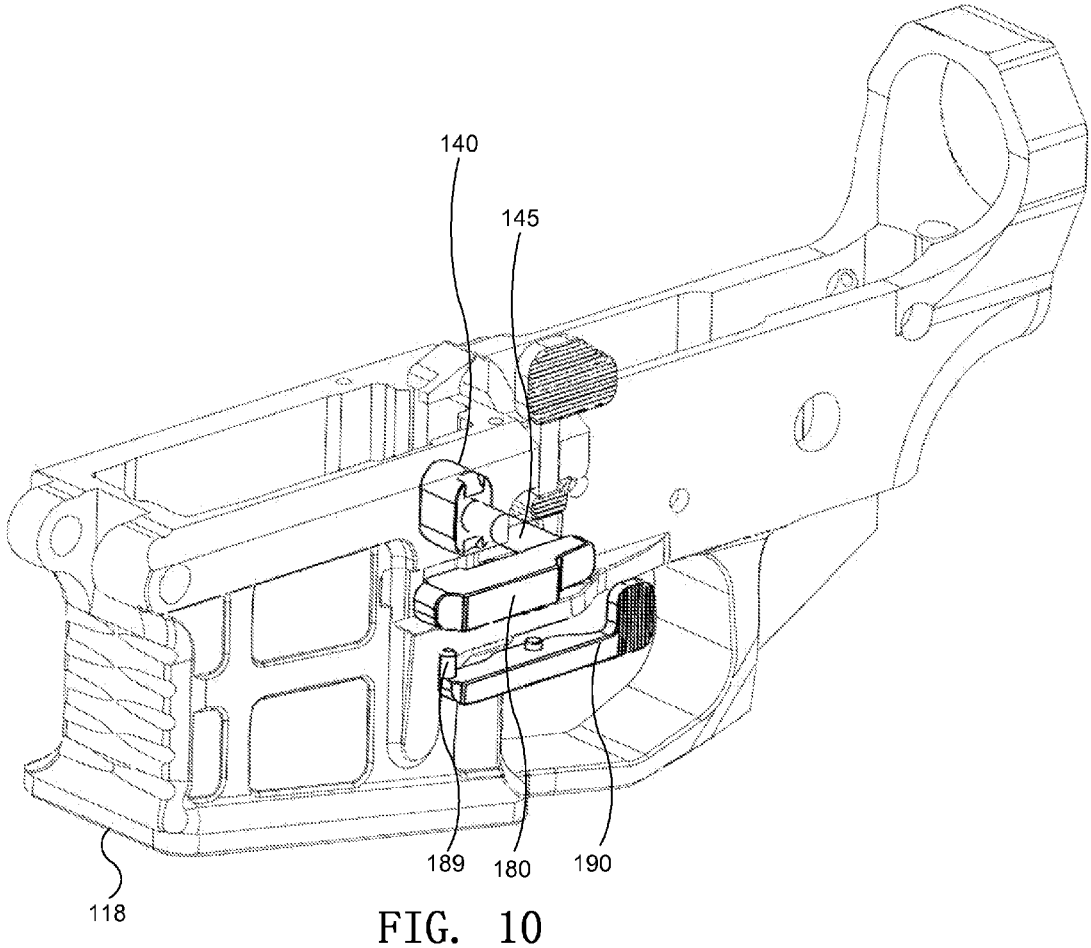
FIG. 10 is a detail diagram of a left hand magazine release mechanism in a disassembly process according to embodiments of the invention.

FIG. 10 is a detail diagram of a left hand magazine release mechanism in a disassembly process according to embodiments of the invention.

Referring to FIG. 10, a magazine release lever 190 may be removed from a firearm during a disassembly process by either fully depressing the magazine release button 140 or pulling the magazine release lever away from the lower receiver portion 118 so that the magazine release lever can be slid off of the magazine catch device 180. Here, the integral link pin 189 used to connect the magazine release lever 190 to the magazine catch device may remain integrated with the magazine release lever. However, in other embodiments, the link pin 189 or another linking mechanism may remain integrated with the magazine catch device 180. In yet other embodiments, the linking mechanism 189 may be a wholly separable component that is not integrated with either the magazine release lever 190 or magazine catch device 180. The magazine catch device 180 may then be easily removed from the lower receiver 118 using the standard method of unscrewing it from the right side magazine release button 140, which also allows for the removal of the magazine release button and connection rod 145.

Thus, rather than having to deal with disassembly of a lever on an internal hinge or other rotation mechanism, the external fulcrum point 199 (FIG. 9) allows the magazine catch and magazine release lever to be simply pulled away from lower receiver portion 118 during disassembly. This may be particularly important in the field where the firearm may need to be cleaned or field stripped with limited tools.

Figure 11:
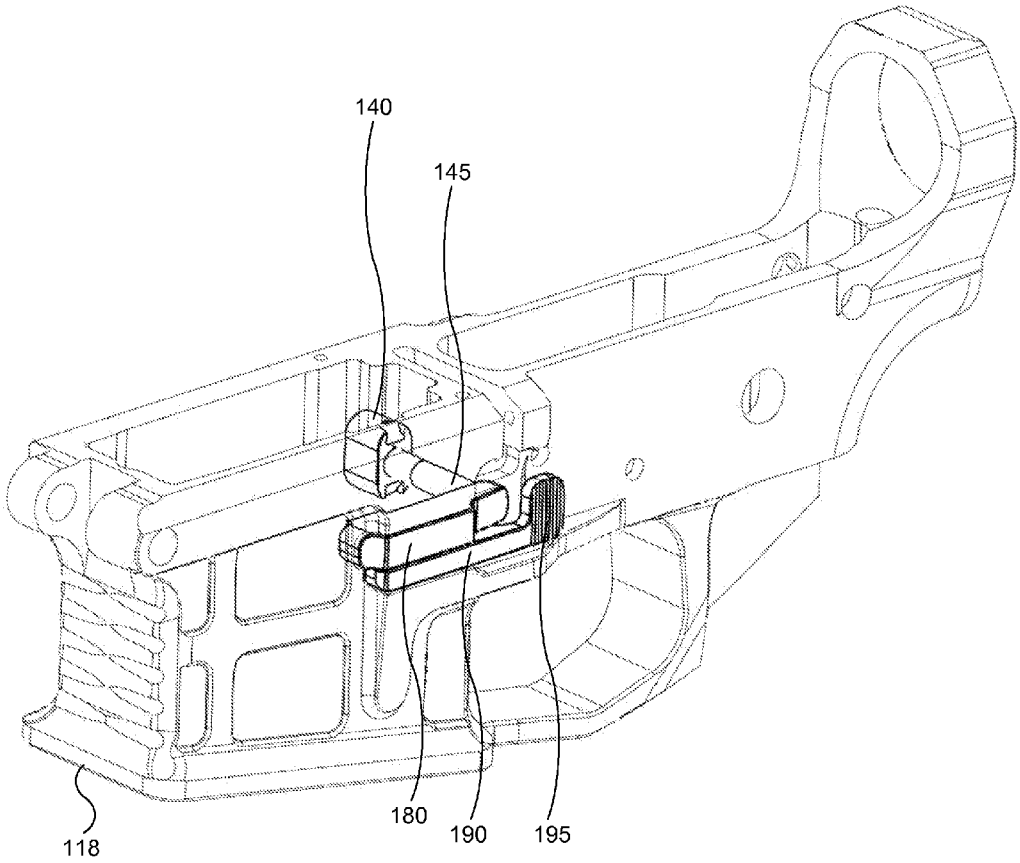
FIGS. 11 and 12 are detail diagrams of the connection between a magazine release button and a left hand magazine release mechanism according to embodiments of invention.
Figure 12:
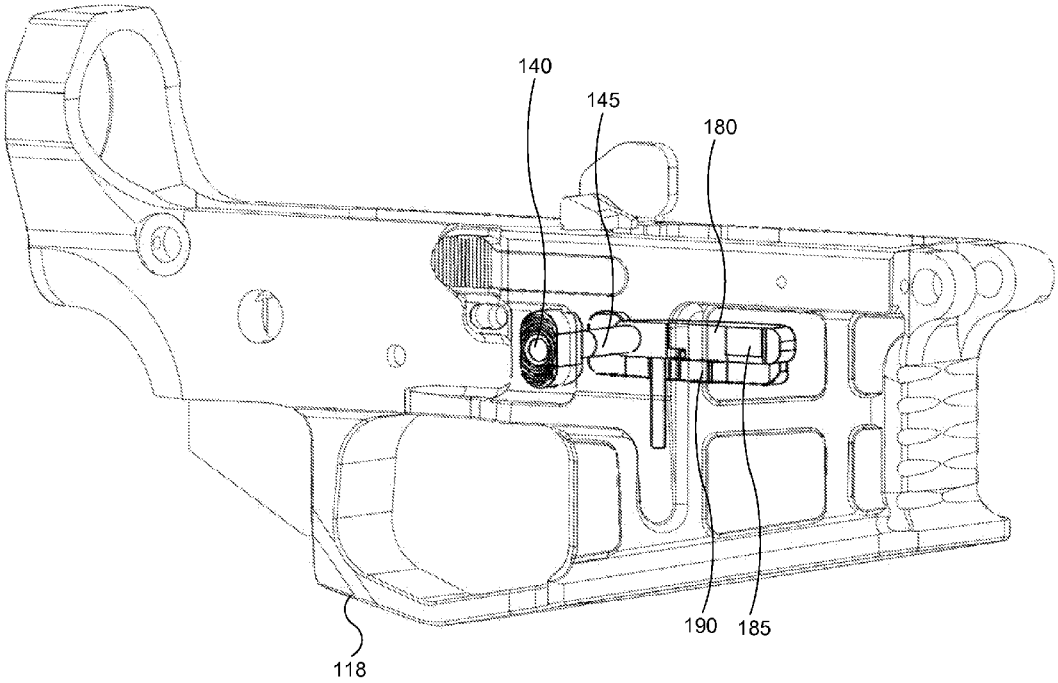

FIGS. 11 and 12 are detail diagrams of the connection between a magazine release button and a left hand magazine release mechanism according to embodiments of invention.

Referring to FIGS. 11 and 12, a magazine release button 140 disposed on a right side of a lower receiver portion 118 may be connected to the magazine catch device 180 with a connection rod 145. Thus, when the release button 140 is depressed with, for example, the index finger of a right handed shooter, the connection rod 145 is laterally disposed from right to left thereby pushing the magazine catch device 180 away from the lower receiver portion 118 and disengaging the raised catch portion 185 from an indentation in a magazine to allow the magazine to be released.

In other embodiments, the magazine release lever 190 may be used in a system described above to lock a firing bolt in place while maintaining a left-handed firing grip so that a jam may be cleared.

As mentioned above, the placement of a magazine release mechanism on only one side of the firearm can cause complications for certain persons operating the firearm. For example a right handed shooter may have to fire and then reload a weapon left handed where the only cover from enemy fire is the corner of a building on his or her right hand side. Quickly finding the magazine release mechanism with the shooters right hand after removing it from the hand guard can prove very difficult in a high stress situation. A firearm equipped with both a right-hand and left-hand magazine release mechanism allows the shooter to us the left hand index finger to simply depress the left side release lever, which is in the same basic position they are accustomed to on the right side while retrieving a new magazine to load into the weapon with their right hand. This provides a much more positive operation of the magazine release mechanism while greatly reducing the time to reload the weapon and be ready to defend oneself.

Figure 13:
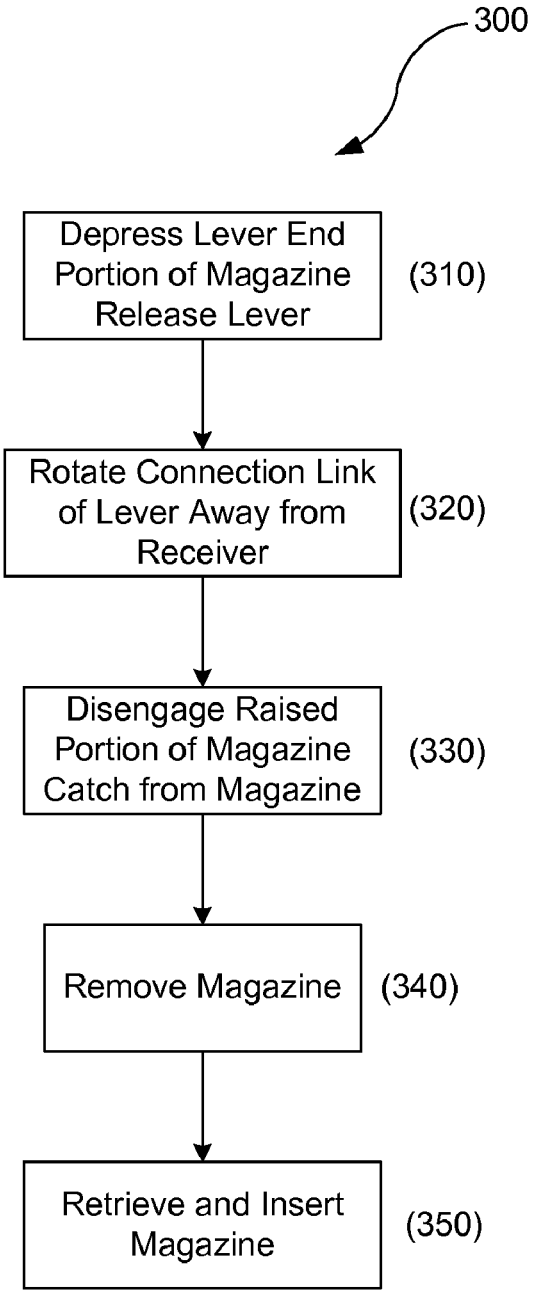
FIG. 13 is a flow diagram of an example method of changing a magazine with an ambidextrous magazine release mechanism according to embodiments of the invention.

FIG. 13 is a flow diagram of an example method of changing a magazine with an ambidextrous magazine release mechanism according to embodiments of the invention.

Referring to FIG. 13, flow 300 begins when a shooter with a left-handed firing grip depresses the lever end portion of a left side magazine release lever with his or her left index finger in process 310. As the lever end portion is depressed, the magazine release lever is rotated about the external fulcrum point and the connection link at the opposite end of the magazine release lever is rotated away from the lower receiver portion in process 320. As the connection link end of the magazine release lever is rotated way from the lower receiver portion, the magazine catch device connected to the magazine release lever through the connection link is pulled away from the lower receiver portion thereby disengaging a raised catch portion from an indentation in a magazine in process 330. Once the raised catch portion is disengaged from the magazine, the magazine can be removed from the firearm either by gravity or with the right hand of the shooter in process 340. Once the removed magazine is cleared, another (or the same) magazine is retrieved by the shooter with his or her right hand and inserted in the magazine well until the raised catch portion of the magazine catch device engages the magazine in process 350.

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out in the appended claims.

The invention claimed is:

1. A firearm apparatus comprising:

a firearm receiver housing a firing chamber, a firearm bolt, and a magazine well configured to accept a magazine of ammunition, where the firearm bolt can be in a locked-open state or a firing state;

a magazine catch configured to retain a magazine inserted into the magazine well of the receiver;

a bolt-catch device installed on the firearm receiver and configured to lock the bolt in a rearward open position;

a magazine release button that is configured to manipulate the magazine catch when pushed in by a user to release the magazine from the magazine well; and a linking pin disposed between the magazine release button and the bolt-catch device, where the linking pin is configured to push the bolt-catch device to a position that locks open the firearm bolt in the locked-open state when the magazine release button is pushed in by a user, the linking in structured to move relative to the bolt-catch device and magazine release button.

2. The firearm apparatus of claim 1, wherein the linking pin is configured to lock open the firearm bolt in the locked-open state substantially simultaneously with manipulating the magazine catch to release the magazine from the magazine well.

3. The firearm apparatus of claim 1, wherein the linking pin is a separate pin that can be removed from the firearm apparatus during disassembly.

4. The firearm apparatus of claim 1, wherein the linking in is disposed in an angularly directed hole between the magazine release button and the bolt-catch device, the linking in configured to contact a lower portion of the bolt-catch device in response to the magazine release button being pressed into the firearm receiver.

5. The firearm apparatus of claim 1, wherein the magazine release button includes an angled ramp configured to engage the linking pin.

6. The firearm apparatus of claim 1, wherein the bolt-catch mechanism includes a notch configured to interface with the linking pin.

7. The firearm apparatus of claim 1, wherein the firearm receiver is configured to release the linking in from the firearm receiver when the magazine release button is depressed to a predetermined depth.

8. The firearm apparatus of claim 1, further comprising a hammer pin having an head that engages a slot in the receiver to prevent the hammer pin from rotating during operation of the firearm.

* * * * *

UNITED STATES PATENT AND TRADEMARK OFFICE

CERTIFICATE OF CORRECTION

PATENT NO. : 8,327,749 B2
APPLICATION NO. : 12/879986
DATED : December 11, 2012
INVENTOR(S) : Joshua A. Underwood It is certified that error appears in the above-identified patent and that said Letters Patent is hereby corrected as shown below:

In the Claims

At Column 12, Line 2, Claim 1, delete "in" and insert --pin--, therefore.

At Column 12, Line 12, Claim 4, delete "in" and insert --pin--, therefore.

At Column 12, Line 14, Claim 4, delete "in" and insert --pin--, therefore.

At Column 12, Line 25, Claim 7, delete "in" and insert --pin--, therefore.

Signed and Sealed this
Fourth Day of June, 2013

Teresa Stanek Rea
*Acting Director of the United States Patent and Trademark Office*